United States Patent [19]

Lopata et al.

[11] Patent Number: 4,674,409

[45] **Date of Patent: * Jun. 23, 1987**

[54] NON-TOXIC, NON-CORROSIVE RIMFIRE CARTRIDGE

[75] Inventors: Frances G. Lopata, Clayton; George C. Mei, Creve Coeur, both of Mo.

[73] Assignee: Olin Corporation, Stamford, Conn.

[ * ] Notice: The portion of the term of this patent subsequent to Jun. 23, 2004 has been disclaimed.

[21] Appl. No.: 869,645

[22] Filed: Jun. 2, 1986

[51] Int. Cl.[4] ..... F42B 5/32

[52] U.S. Cl. ..... 102/471; 102/283; 102/285; 102/289; 102/322; 149/43

[58] Field of Search ..... 102/283, 285, 289, 470–472, 102/465–467, 322; 149/2, 21, 43

[56] References Cited

U.S. PATENT DOCUMENTS

| | | | |
|---|---|---|---|
| 3,926,119 | 12/1975 | Hurst et al. | 102/315 X |
| 4,047,989 | 9/1977 | Ostern | 149/88 X |
| 4,218,272 | 8/1980 | Brockington | 149/43 X |
| 4,376,002 | 3/1983 | Utracki | 149/40 X |
| 4,490,195 | 12/1984 | Cooper et al. | 149/45 X |
| 4,566,921 | 1/1986 | Duguet | 149/22 |

*Primary Examiner*—Peter A. Nelson
*Attorney, Agent, or Firm*—Bruce E. Burdick

[57] ABSTRACT

This invention relates to non-toxic, non-corrosive, lead-free rimfire ammunition.

7 Claims, 1 Drawing Figure

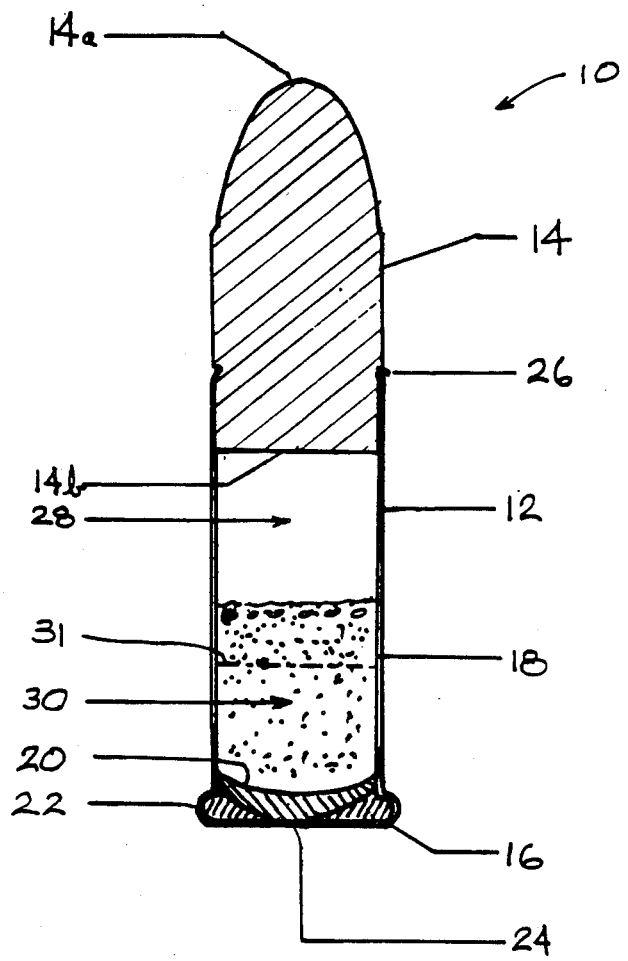
14a
10
14
26
14b
28
12
31
18
30
20
22
16
24

NON-TOXIC, NON-CORROSIVE RIMFIRE CARTRIDGE

STATEMENT OF INTEREST

This invention was developed under government contract, but the assignee has elected to retain title to the patent. The invention may be used by or for the U.S. Government without payment of royalty.

BACKGROUND AND SUMMARY OF THE INVENTION

There is international concern about the amount of airborne toxic materials found in shooting ranges, particularly airborne lead. The Federal Government of West Germany has set the maximum permissible workplace concentration of lead dust at 0.1 mg of lead per cubic meter of air. During tests at German and non-German shooting ranges, equipped with various types of ventilation systems, concentrations of up to 9 mg of lead per cubic meter were measured over exposures of 4–6 hours when conventional, fully jacketed 9×19 mm Luger (parabellum) ammunition was used. This high airborne lead concentration is also found in some indoor shooting range using .22 caliber rimfire ammunition. The main problem is thought to come from the lead styphnate and barium nitrate used in the priming composition.

One attempt to solve the above problem for centerfire ammunition (which has a battery cup primer or Berdan primer placed in the center of the cartridge base) has been the use of "Sintox" primer developed by Dynamit Nobel of Troisdorf, West Germany which is thought to use an amorphous dinol initiating explosive mixed with zinc and titanium compounds rather than lead or barium compounds. However, that priming composition is not suitable for priming rimfire cartridges because it does not have the necessary sensitivity for use as a rimfire priming mix and because it does not have a small enough particle size to fit into the rim of the cartridge during the priming procedure. Also, "Sintox" primer is a centerfire primer and as is the case with most centerfire primer mixes, has less sensitivity than that required to function as a rimfire primer. Dinol-based priming mix having a smaller crystalline size than that of the "Sintox" primer was made and was tried by applicant's predecessors at Olin Corporation about 40 years ago, but that mix contained lead in forms of lead thiocyanate and lead peroxide and is thus not suitable as a lead-free primer mix. Thus, a need remains for a lead-free primer mix for .22 caliber rimfire cartridges.

Also of concern is the bullet. Caliber .22 bullets are conventionally made of lead which is sometimes plated with copper for aesthetic reasons. There is a concern that some of the airborne lead found in indoor shooting ranges may be caused by vaporization of the lead base of the bullet, frictional wear during passage of the bullet through the barrel or air and/or "dusting" (or minute fragmentation of the lead bullet) upon impact of the lead bullet with the target or backstop. Copper bullets, aluminum bullets and other non-lead bullets are known as a solution to the concern about airborne lead from the bullet.

A solution to this problem of needing a lead-free, non-toxic .22 caliber rimfire cartridge has been long sought after. Rimfires have been in existence for many, many years without such a primer having been found. It is well known that rimfire priming mixes must have a considerably greater sensitivity than that required by centerfire primers, so even if a low sensitivity lead-free centerfire primer mix is found, it is not obvious how to make a high sensitivity lead-free, non-corrosive, non-toxic rimfire priming mix. The phrase "Non-toxic" as used herein means consisting essentially of materials which are not heavy metals such as lead or barium and not known carcinogens or poisons, especially when vaporized, burnt or exploded as in the firing of an ammunition round. "Lead free" as used herein means having less than one per cent by weight lead. "Non-corrosive" as used herein means not containing halogens and thus producing any significant combustion products which are corrosive to iron or steel barrels. The problem is such that the U.S. Government's Army Research and Development Center issued a contract to Olin Corporation to study the feasibility of developing such a primer.

During this study, the present invention was made and is being recognized by both Olin and the Government as a major breakthrough in rimfire technology.

A solution to the above problem is achieved by the present invention which provides a rimfire cartridge which includes a shell case, a non-lead metallic bullet, a non-toxic rimfire priming composition, a non-toxic propellant powder and a nitrocellulose foil between the primer and the propellant. The preferred primer mix consists essentially of $MnO_2$, tetrazene, dinol and glass. It is believed that manganese dioxide has never before been used as an oxidizer in ammunition primers, and especially not in rimfire cartridges. It was also believed that 13% nitrated nitrocellulose foils have never been used before in rimfire cartridges and it is further believed that there has never before been a non-toxic, non-corrosive, lead-free rimfire cartridge.

The invention will be better understood by reference to the attached drawing in which the FIGURE is a longitudinal diametrical cross-section along the axis of a loaded cartridge of the invention.

DETAILED DESCRIPTION

The priming mix of the invention contains dinol as the initiating explosive, manganese dioxide as the oxidizer, tetrazene as the sensitizer and glass as the co-sensitizer and is intended for use in rimfire cartridges such as .22 caliber cartridges. The manganese dioxide-dinol combination is essential to the overall success of the dinol based primer mix because the manganese dioxide provides the needed oxidizer strength to catalize the reaction and has water insolubility for wet processing without being corrosive (as are halogen-containing oxidizers or explosives).

The manganese dioxide concentration in the mix can range from about 10% up to about 40% by weight, with the particular concentration dependent on the relative concentrations of the other ingredients in the mix. A manganese dioxide concentration in the mix within the range of from about 15% to 25% by weight of the mix is preferred.

The dinol particles should be small enough to pass through a screen having 250 micron openings. One such dinol particle is that made according to the procedure described in U.S. Pat. No. 2,408,059, issued to Olin Industries, Inc. (now Olin Corporation) entitled "Manufacture of Diazodinitrophenol" and issued Sept. 24, 1946, the disclosure of which is incorporated herein by reference as if set forth at length. The U.S. Pat. No.

2,408,059 calls for use of an absorbed triphenylmethane dye as a crystal growth control agent.

The concentration of dinol in the present priming mix of the invention is within the range of from about 25% up to about 40% by weight. The precise concentration of dinol is dependent on the amount of tetrazene, since those two ingredients provide the explosive energy to the mix. It is preferred that the combined weight percentages of dinol and tetrazene in the mix be within the range of from about 40% to about 60%.

The tetrazene can be standard commercial grade and is used in the mix in a concentration by weight within the range of from about 10% up to about 40% of the mix.

The glass can be standard rimfire glass (i.e. the same glass as used in conventional rimfire primers) and is used in the mix in a concentration by weight within the range of from about 10% up to about 30% of the mix.

The mixture can be made by a wet process, which is very desirable for rimfire applications where the primer is typically spun into the rim and the liquid flow properties are needed for uniformity of primer around the rim.

Referring to the FIGURE, a rimfire cartridge 10 is shown which comprises a shellcase 12, a bullet 14, a primer 16, a propellant powder 18 and a thin sheet 20 of compacted propellant herein called a "foil." Specifically, the foil 20 is comprised of a nitrocellulose layer nitrated to greater than 13% by weight nitrogen in the nitrocellulose. The foil 20 of the invention is located above primer mix 16 at the base of shell 12 and serves to be sure that a portion of the propellant is always located adjacent the primer so that such portion will consistently and reliably ignite upon detonation of the primer, even where the cartridge is fired in a gun with the muzzle aimed downward where the loose propellant powder would otherwise be adjacent the bullet and instead of space 28 shown in FIGURE, the powder 18 would be located adjacent the rear end or "heel" **14*b* of bullet 14 so that there would be a space 30 between the primer 16 and propellant powder 18. Space 30 would be located below point 31 just above the primer 16. Without the foil in such a situation it is thought that the cartridge could misfire if the flame front from the primer detonation failed to cross space 30 well enough to reach point 31**. The foil thus allows the use of a somewhat less sensitive primer composition while still having good powder ignition.

The bullet 14, which has a front end or "nose" **14*a* and a rear end or "heel" 14*b***, is preferrably of solid copper so that no lead contamination of the air from the bullet is possible upon firing the ammunition containing the bullet.

One advantage of the ammunition of the invention is that is contains no heavy metals such as lead or barium and thus is not toxic. The ammunition also contains no halogens and is non-corrosive. This is believed to be the first and only non-corrosive, non-toxic rimfire cartridge which can be safely and economically substituted for existing rimfire cartridges containing lead compounds and barium compounds in their primers without causing primer-related ammunition defects such as misfires, no-fires, hang fires or premature fires.

EXAMPLES

1. A priming composition was prepared by mixing water-desensitized tetrazene and dinol to form the premix. To this premix was then added glass and mangenese dioxide in layers. Subsequent thorough mixing completed the process. This mix had a (MIX 16E) composition of 30% by weight dinol, 30% by weight tetrazene, 20% manganese dioxide and 20% standard rimfire fine glass. This water wetted mix was applied into the rims of .22LR cartridges in an amount calculated to give a dry primer mix charge weight of 0.6 grains.

Sensitivity of the primed case with the mixture was tested by using Probst's method with a 1.94 ounce steel ball from measured heights varied by one inch increments. Twenty-five primed cases were tested at 11" drop height and all fired without misfire. Using the Probst method, the average drop height for 50% fire("H") was 5.7" with a standard deviation ("S") of 0.4" with H+4S=7.3" and H-2S=4.7". In a standard test for safety, 100 shellcases primed with the composition were tested by dropping a 1.94 ounce steel ball from a height of one inch onto the rim of the case. No detonations occurred, thus indicating the cartridges were not overly sensitive and should be safe to handle (a single detonation is considered a failure in this safety test).

Ignition characteristics were tested by testing pressure and velocity (P&V), ignition barrel time (IBT) and pressure-time characteristics (P-T). The results were:

V=1488 fps

P=23,100 psi

IBT=1.92 ms when loaded into a standard Long Rifle (LR) .22 caliber case with a 29 grain copper LR projectile and 1.8 grains of Bullseye #85 propellant.

Stability of the cartridge was tested by storing 20 rounds of .22 caliber LR cartridges having the priming mix composition and 20 rounds of standard .22 caliber LR cartridges at 115° F. at 85% relative humidity and the same number of each sample at 70° F. for 2 weeks and then fired to determine pressure and velocity. Pressure and velocity were not found to change significantly, thus the priming mix in the cartridge was judged stable.

The cartridge was tested for function and casualty by shooting 100 rounds of .22 caliber LR cartridges primed with the priming composition and 100 rounds of standard .22 caliber LR cartridges in each of 5 types of .22 caliber rifles used by the U.S. Government. Function and casualty were found to be equivalent to conventional primed cartridges. Function and casualty done five months after loading were also found to be equivalent to conventional rounds with no change in the results, further showing priming mix stability in the cartridge.

The net result of all of the testing was that the non-toxic, lead-free cartridge of the invention was found to be effective.

What is claimed is:

1. A rimfire cartridge which comprises:

a shellcase having an open front end, a closed rear end and an annular hollow rim open to an interior space of the shellcase at the closed end, an essentially lead-free metallic bullet mounted in and closing the open end; a non-toxic propellant granular powder partially filling the interior of the shellcase between the bullet and the closed end; a primer disposed in the rim which primer consists essentially of a lead-free, non-toxic, non-corrosive mixture of dinol, manganese dioxide, tetrazene and glass; and a sheet of compacted propellant disposed adjacent to the primer for assisting in the ignition of the powder.

2. The cartridge of claim 1 in which the weight percentage of the ingredients in the composition of the primer is within the following ranges:

dinol: 25%–40%
manganese dioxide: 10%–40%
tetrazene: 10%–40%
glass: 10%–30%.

3. The cartridge of claim 2 wherein the dinol has a particle size within the range of from about 30 microns up to about 250 microns.

4. The cartridge of claim 2 wherein the combined weight percentage of dinol and tetrazene in the composition is within the range of from about 40% up to about 60%.

5. The cartridge of claim 2 wherein the weight percentage of manganese dioxide in the mix is within the range of from about 15% to about 25%.

6. The cartridge of claim 2 wherein the weight percentage of dinol in the mix is within the range of from about 25% to about 35%.

7. The cartridge of claim 1 wherein the foil is nitrocellulose nitrated to greater than 13% by weight nitrogen.

* * * * *